US007399140B2

(12) United States Patent
Barcenas

(10) Patent No.: US 7,399,140 B2
(45) Date of Patent: Jul. 15, 2008

(54) POWER TROWEL ATTACHMENT FOR A DRILL

(76) Inventor: Lauro Barcenas, P.O. Box 756, Thousand Palms, CA (US) 92276

( * ) Notice: Subject to any disclaimer, the term of this patent is extended or adjusted under 35 U.S.C. 154(b) by 0 days.

(21) Appl. No.: 11/787,238

(22) Filed: Apr. 16, 2007

(65) Prior Publication Data

US 2008/0025794 A1 Jan. 31, 2008

Related U.S. Application Data

(63) Continuation-in-part of application No. 11/495,977, filed on Jul. 27, 2006, now abandoned.

(51) Int. Cl.
*E01C 19/22* (2006.01)

(52) U.S. Cl. ..... 404/112; 451/350

(58) Field of Classification Search ..... 404/112; 451/350

See application file for complete search history.

(56) References Cited

U.S. PATENT DOCUMENTS

| | | | | |
|---|---|---|---|---|
| 2,108,470 | A | 2/1938 | Boulton | |
| 2,198,929 | A | 4/1940 | Whiteman | |
| 2,277,389 | A | 3/1942 | Conway | |
| 2,394,274 | A | 2/1946 | Troxell | |
| 2,667,824 | A * | 2/1954 | McCrery | 404/112 |
| 2,860,506 | A | 11/1958 | Drummond | |
| 3,402,647 | A * | 9/1968 | Colizza et al. | 404/112 |
| 4,046,483 | A | 9/1977 | Sutherland | |
| 4,198,178 | A | 4/1980 | Carlstrom et al. | |
| 4,320,986 | A | 3/1982 | Morrison | |
| 4,388,017 | A | 6/1983 | Morrison | |
| 4,740,348 | A | 4/1988 | Rose | |
| 4,850,758 | A | 7/1989 | Morgan | |
| 5,221,156 | A | 6/1993 | Martin | |
| 5,372,452 | A | 12/1994 | Hodgson | |
| 5,762,545 | A | 6/1998 | Edwards | |
| 6,019,545 | A * | 2/2000 | Allen et al. | 404/112 |
| 2006/0083589 | A1 | 4/2006 | McLain | |

* cited by examiner

*Primary Examiner*—Raymond W Addie
(74) *Attorney, Agent, or Firm*—Kirk A. Buhler; Buhler & Associates

(57) ABSTRACT

A drill attachment for smoothing the edges and corners of a concrete slab is disclosed. The drill attachment includes a shaft that is secured or chucked into an electric drill. Pluralities of troweling blades extend from the central shaft and are secured at their ends to maintain their position and orientation. The blades are secured to the trowel at variable or fixed angles that are changeable to suit the finishing need of the operator. In operation the drill attachment is used to smooth the ends and corners of a foundation where larger smoothing trowel machines have difficulty reaching. The power trowel is field installed and removed when needed for use, cleaning and storage. The drill attachment has an independently spinning blade cover extends over the ends of the blades to prevent damage to a wall or other surface when the trowel is in use.

20 Claims, 4 Drawing Sheets

POWER TROWEL ATTACHMENT FOR A DRILL

CROSS REFERENCE TO RELATED APPLICATION

This application is a continuation-in-part of applicant's application Ser. No. 11/495,977 filed Jul. 27, 2006, now abandoned, the entire contents of which is hereby expressly incorporated by reference herein.

DESCRIPTION

1. Field of the Invention

This invention relates to improvements in a drill attachment where the drill attachment is a smoothing device for smoothing concrete. More particularly, the present drill attachment includes a shaft that is secured or chucked into an electric drill. Pluralities of trowels extend from the shaft and are secured at their ends to maintain their position and orientation. In operation the drill attachment is used to smooth the ends and corners of a foundation where larger smoothing trowel machines have difficulty reaching. An independently spinning blade cover extends over the ends of the blades to prevent damage to a wall or other surface when the trowel is in use. The blades are secured to the trowel with fixed angle inserts that are changeable to suit the finishing need of the operator.

2. Background of the Invention

Concrete includes a combination of water sand and rock or aggregate material. When the wet concrete is poured into a slab, the slurry is in a semi homogeneous condition where the rock exists both within the wet slab and on the surface. The rocks are moved under the top surface of the pad by vibration, tamping and by troweling the slurry to create a smooth top surface with little or no visible rock aggregate. In large construction projects the troweling is performed with gas or electric powered troweling or float vehicles that are driven on and around the surface to smooth the pad. Because of the size of these vehicles, navigation around the edges and corners is difficult and dangerous. The most effective way to handle the edges and corners is with a small hand trowel and more efficiently with a powered hand trowel as disclosed herein. Several patents have been issues of devices to smooth a wet concrete pad and some exemplary examples are identified herein.

U.S. Pat. Nos. 2,108,470, 2,198,929, 2,277,389, 2,394,274, 4,046,483, 4198,178 and 4,320,986 each disclose a concrete finishing or troweling machine that includes troweling rotors attached to a motor with an elongated handle that the operator holds to guide and control the finishing of the machine. While these patents disclose machines for finishing or troweling concrete, they all contain the motor or drive mechanism and too large for finishing the corners or edges of a foundation. They are also permanently attached to the drive motor making them dedicated machines having only one purpose. The drive motor is only used in the finishing, it can not be separated to drill holes or perform other functions.

U.S. Pat. No. 5,221,156 issued to Harlan S. Martin on Jun. 22, 1993 discloses a concrete finishing machine providing a more compact concrete finishing machine where an operator grips the support arms and guides the machine in smaller areas. While this patent discloses a machine for finishing or troweling concrete, it contains the motor that is permanently attached, thus dedicating the machines for only one purpose. The drive motor is only used in the finishing, it can not be separated to drill holes or perform other functions.

U.S. Pat. No. 2,860,506 issued to J. D. Drummond on Nov. 18, 1958 discloses a Power Driven Plastering Trowel for smoothing plaster placed on a wall. In this patent the plurality of trowels are individually secured into the trowel. The angle of the troweling blades is not adjustable. The plastering trowel is further not removable from the power device, nor is it used to smooth concrete.

U.S. Pat. No. 5,762,545 issued to Kerri O. Edwards on Jun. 9, 1998 discloses a Sanding Disk with Extended Blades. This patent is for a sanding disk attachment for a drill where the sanding disk includes four extended arms. The purpose of the product is to sand. One of the features of this patent is the ability to wrap standard sheets of sandpaper around each on the arms, as opposed to using custom or cut sheets of material. While this patent discloses an attachment for a drill with radial arms, the tool is not intended for use in the finishing of concrete nor is the angle of the arms adjustable or pivotable to conform to the concrete being smoothed.

What is needed is an attachment for a drill that is easily installed and removed to allow the drill to be used for other purposes. The ideal drill attachment would be small enough to allow it to smooth concrete edges and corner. The troweling blades would be adjustable or fixable to affect the smoothing characteristics of the drill. The proposed power trowel drill attachment satisfies these requirements.

BRIEF SUMMARY OF THE INVENTION

It is an object of the power trowel attachment for a drill to provide an installable and removable attachment for a drill that is used to trowel the edges and corners of a concrete slab that has been poured. The temporary attachment to a drill allows the drill to be usable for other purposes both before and after the drill is used to trowel concrete. Since a power drill is a common piece of equipment at a construction site the only additional component is the power troweling attachment. The ability to remove the power trowel from the drill allows a more complete cleaning or the power trowel because it can be removed from any electrical components that might be damaged from water or other cleaning materials.

It is an object of the power trowel attachment to provide troweling blades that pivot to move over the concrete and provide a smoother finish. The angle on the pivoting blades is controllable with an adjustable bolt to maintain position and angle of the blades.

It is an object of the power trowel attachments small size to permit easy portability, storage and versatility to use the power trowel in areas where larger power trowels can not reach due to safety or size of the vehicles. The small size allows the tool to be walked around the perimeter or inside of a poured slab and quickly smooth the perimeter, corners and edges. Because the tool is small in size it is also useable to touch-up areas that are accidentally damaged or require quick smoothing.

It is an object of the power trowel attachment safety ring that extends around the trowels to reduce the potential for harm, damage or injury from the rotating trowel blades.

It is an object of the power trowel attachment to have changeable blades that are individually removable and or replaceable to accommodate servicing of the power trowel as required to maintain optimal operation.

It is an object of the power trowel attachment to make the shaft that is chucked into the drill triangular or tri-roundular in configuration to reduce rotation of the shaft in the drill chuck.

It is an object of the power trowel attachment to include a trowel blade cover that extends over the ends of the blade. The cover can spin independently from the blades to prevent the blades from marking or gouging into a wall surface or body part that may get near the troweling blades.

It is an object of the power trowel attachment to blades is a fixed angular configuration. The fixed angle is with changeable angle inserts. The inserts are removable and changeable based upon the troweling needs. The different angles allow the power trowel to operate as both a roughing trowel for initial material spreading and a smoothing trowel for finishing detail work.

It is still another object of the transmission to incorporate a transmission between the input shaft and the trowel blades to alter the rotational speed of the blades. The transmission provides a slower rotational speed of the blades with higher drill turning speed to reduce the load on the drill at slower speed. The transmission further provides better control of the rotating trowel blades when they are spun at a slower rate of speed. The transmission provides the advantage of using a drill with a lower power rating or a drill that is battery powered allowing the tool to be used without a power cord attachment.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
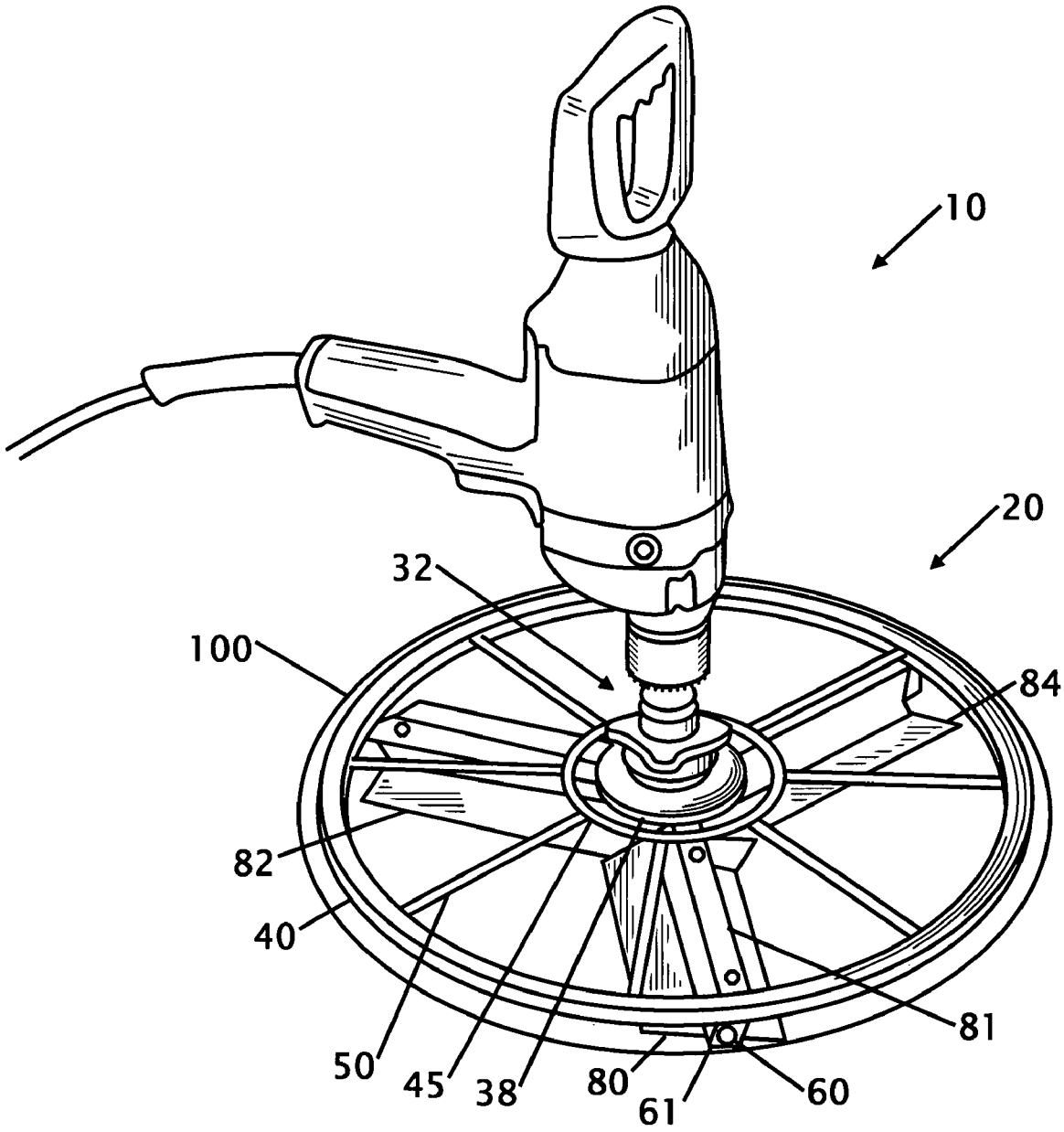
FIG. 1 shows an isometric view of the trowel secured in a drill.

FIG. 1 shows an isometric view of the trowel secured in a drill. The drill 10 is shown for reference. In the drill shown in this FIG. is a corded power drill, but it is contemplated that the power trowel can equally be used with a battery powered drill. The power trowel 20 is chucked into the drill the same as a drill bit would be chucked into a drill. The end of the tool that is chucked into the drill is round but is preferably hexagonal, triangular or tri-roundular in configuration to reduce rotation of the shaft in the drill chuck. The input shaft attaches to a central structural hub where the remainder of the power trowel expands from. In one embodiment the central hub 32 includes a transmission such as a universal gear box. The transmission provides a slower rotational speed of the blades with higher drill turning speed to reduce the load on the drill at slower speed. The transmission further provides better control of the rotating trowel blades when they are spun at a slower rate of speed. The transmission provides the advantage of using a drill with a lower power rating or a drill that is battery powered allowing the tool to be used without a power cord attachment. Working prototypes have been fabricated without a transmission and have been successful in operation.

Three troweling blades 80, 82 and 84 are equally radially spaced around the central hub 32. These troweling blades provide the smoothing of the concrete. The blades consist essentially of a flat lower surface. The blades are preferably fabricated from steel, but other materials are contemplated that provide equivalent performance. Other materials from aluminum, plastics or wood are contemplated to provide various smoothing characteristics. The trowel blades are attached to a trowel supports 81, 83 and 85 where only support 81 is identified in this FIGS. 4-8.

The trowels are secured with fasteners that allow removal, replacement or servicing. The combination trowel and trowel support are pivotably secured to the power trowel with bushings, with outer bearings or pivot points 60. Inner bearings are not shown in this FIG. but the combination of outer and inner bearings support the trowel blades and allow them to pivot. The pivoting mechanism is shown and described in more detail with FIGS. 4 to 7 herein. The outer bearings, bushings exist in an outer bearing riser 61 that is welded to the outer ring or safety ring 40 that extends around the trowels to reduce the potential for harm, damage or injury from the rotating trowel blades. A top cover 100 is shown that wraps over the sides of the blades. The cover is connected to the central hub 32 with a bearing. The bearing allows the cover to spin independently from the troweling blades. This is partially useful to prevent the blades from scraping a wall or the leg of a user. With the top cover 100 comes in contact with a surface the cover stops spinning and guards the blades from extending beyond the top cover. The cover is designed to terminate slightly above the bottom of the blades 80 to prevent to cover from marking the toweled surface.

A series of ribs 50 extend from the outer ring 40 to the inner ring 45. This series of ribs provide structural strength to the power trowel maintaining even load distribution and help to keep hand and or fingers out of the turning trowel blades 80, 82, and 84. A stop plate exists between the inner ring and the central hub 32. The stop ring 38 limits the angular rotation of the troweling blades. The function and configuration of the stop ring is shown and described in more detail with FIGS. 4 to 8.

Figure 2:
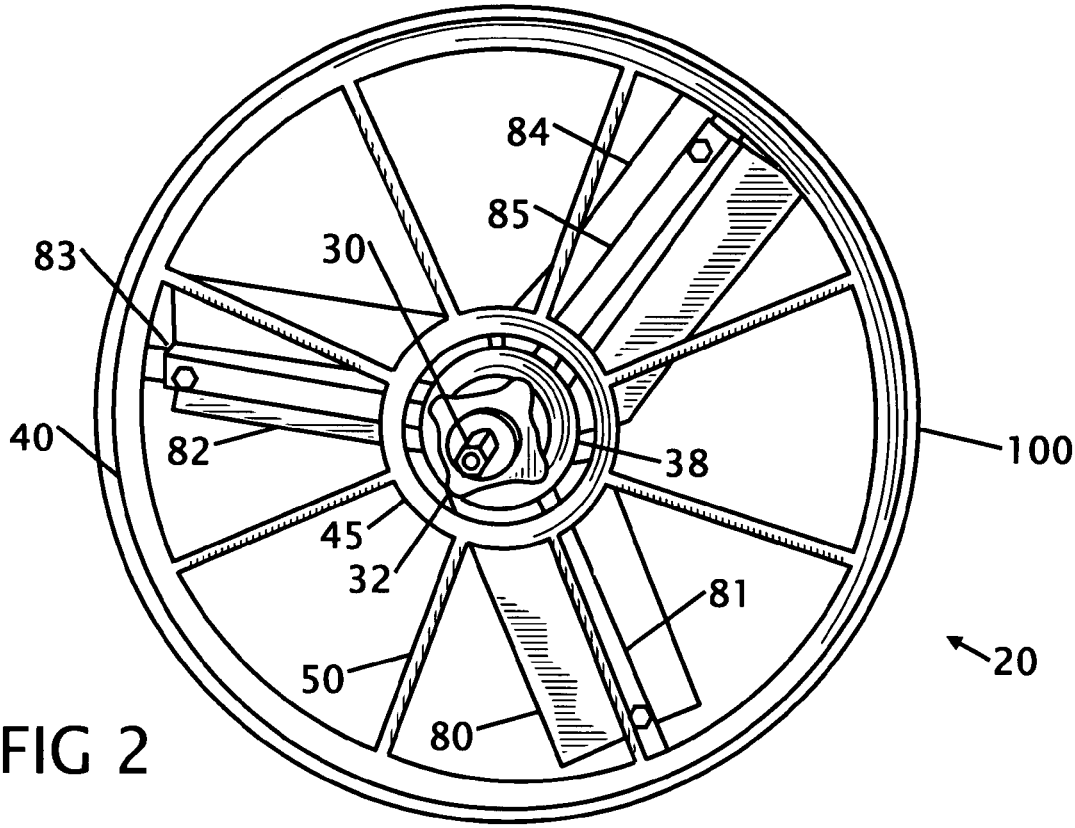
FIG. 2 shows a top view of the trowel.
Figure 3:
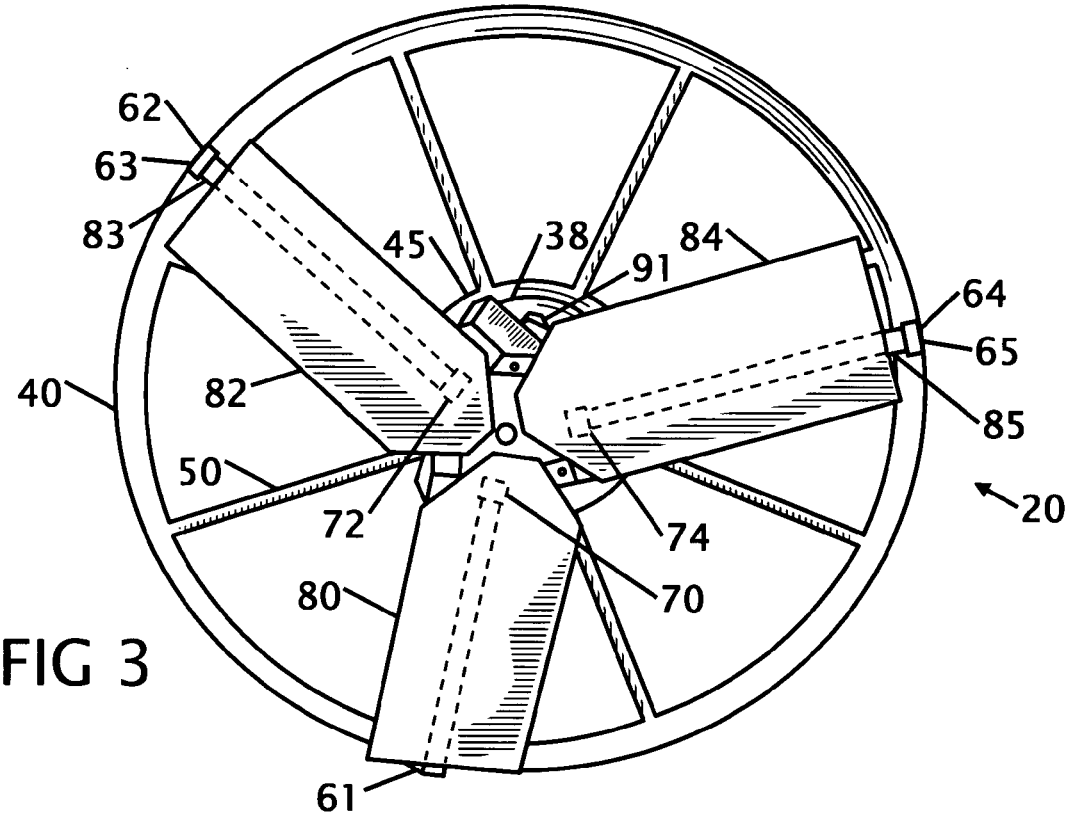
FIG. 3 shows a bottom view of the trowel.

FIGS. 2 and 3 show a top and bottom view of the power trowel 20 respectively. The hexagonal input shaft 30 is shown in FIG. 3 where the drill is chucked onto the power trowel. The central hub 32 is shown with a four sided hub. The hub makes it easier to grip the power trowel and hand chuck the power trowel into a drill. The stop ring 38 is most visible in FIG. 38 where it encircles the central hub 32. The stop ring 38 limits the angular rotation of the troweling blades. The outer ring 40 and the inner ring 45 are shown with the ribs 50 extending between these two rings. A total of eight ribs are shown, but as few as three ribs are contemplate to a plate made or transparent (not visible) that extends across the area between the inner 45 and outer 40 rings.

Referring mostly to FIG. 3, the blades 80, 82 and 84 or visible. The shape of the blades is essentially rectangular, and has a taper where they become closer in the central portion of the power trowel. The narrowing area in the center allows the trowels to more evenly smooth the concrete in the middle are. The blades are attached to blade supports shown as items 81, 83 and 85 in FIG. 2 and as broken lines in FIG. 3. The blades 80, 82 and 84 are removable from the blade supports 81, 83 and 85 for servicing, cleaning, replacement or changing. In FIG. 3 the outer bearing risers 61, 63 and 65 are shown protruding from the outer ring 40. These risers include the outer bushings, bearings or holes 62 and 64 for the trowels to pivot within. The inner bearing, bushings, or holes 70, 72 and 74 are shown as broken lines in FIG. 3 where they secure the inner ends of the trowel and trowel supports 81, 83 and 85. The head of one of the rotation limiting bolts 91 is shown near the stop plate 38.

Figure 4:
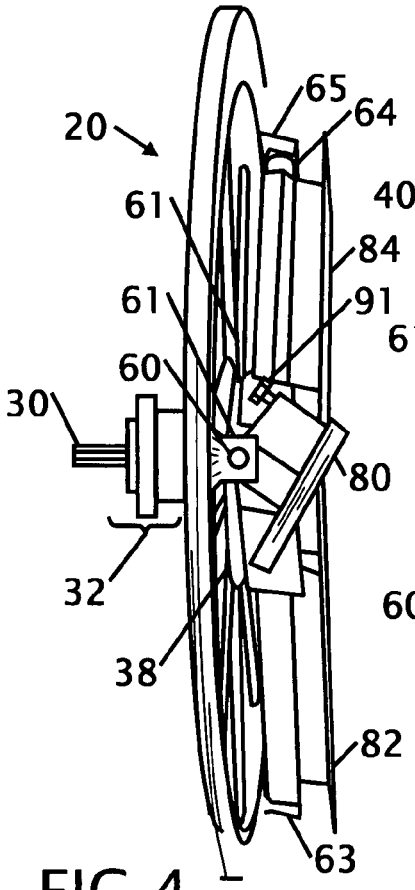
FIG. 4 shows a side view of the trowel.
Figure 5:
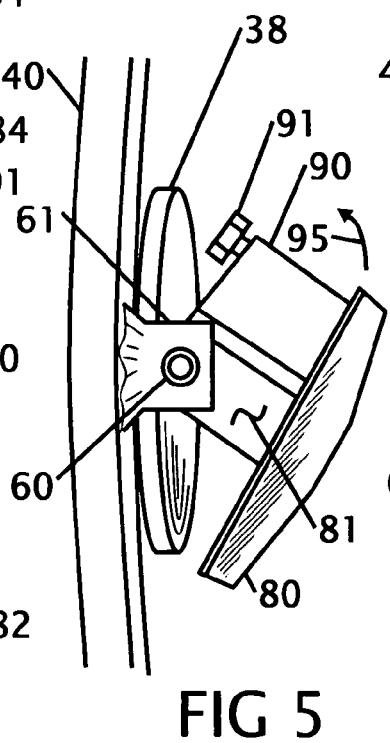
FIG. 5 shows an enlarged partial side view of the trowel showing a pivoting trowel partially rotated.
Figure 6:
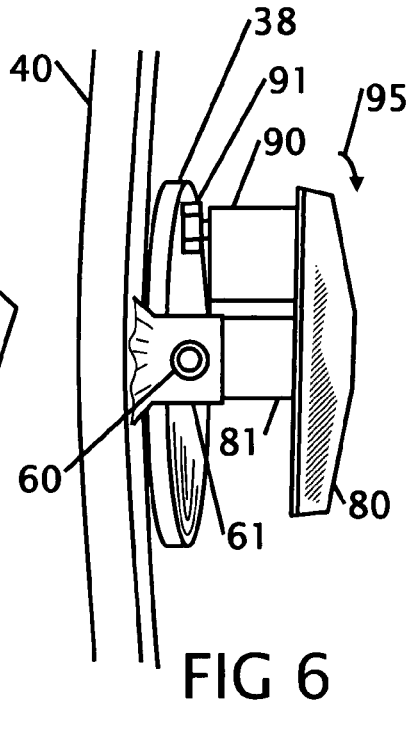
FIG. 6 shows an enlarged partial side view of the trowel showing a pivoting trowel rotated against the stop.

FIG. 4 shows a side view of the power trowel 20. This view will be briefly described because the details in this FIG. contains a number of elements that will be described in more detail in FIGS. 5 and 6 where FIGS. 5 and 6 are an enlarged part of FIG. 4 with extraneous items removed to show the pivotal motion of one trowel blade. The input shaft 30 is connected to the central hub 32.

FIGS. 5 and 6 shows an enlarged partial side view of the trowel showing the pivoting mechanism and the pivoting of a trowel. FIG. 5 shows the trowel partially rotated, while FIG. 6 shows the trowel rotated against the stop. The edge of the outer ring 40 is visible in both these figures. Outer bearing 60 is shown with a similar bearing 64 on another blade rising from the outer bearing riser 61. Trowel blade 80 is shown in a rotated 95 orientation in FIG. 5 and in a vertical orientation in FIG. 6 where the head of the adjustment bolt 91 is shown in contact with the stop plate in FIG. 6 and rotated 95 away from the stop plate in FIG. 5. The trowel support 81 support the trowel blade 80 and included the pivot for the bearing. An arm 90 extends from the blade support to provide a leaver arm for the trowel blade 80 and the trowel support 81.

Figure 7:
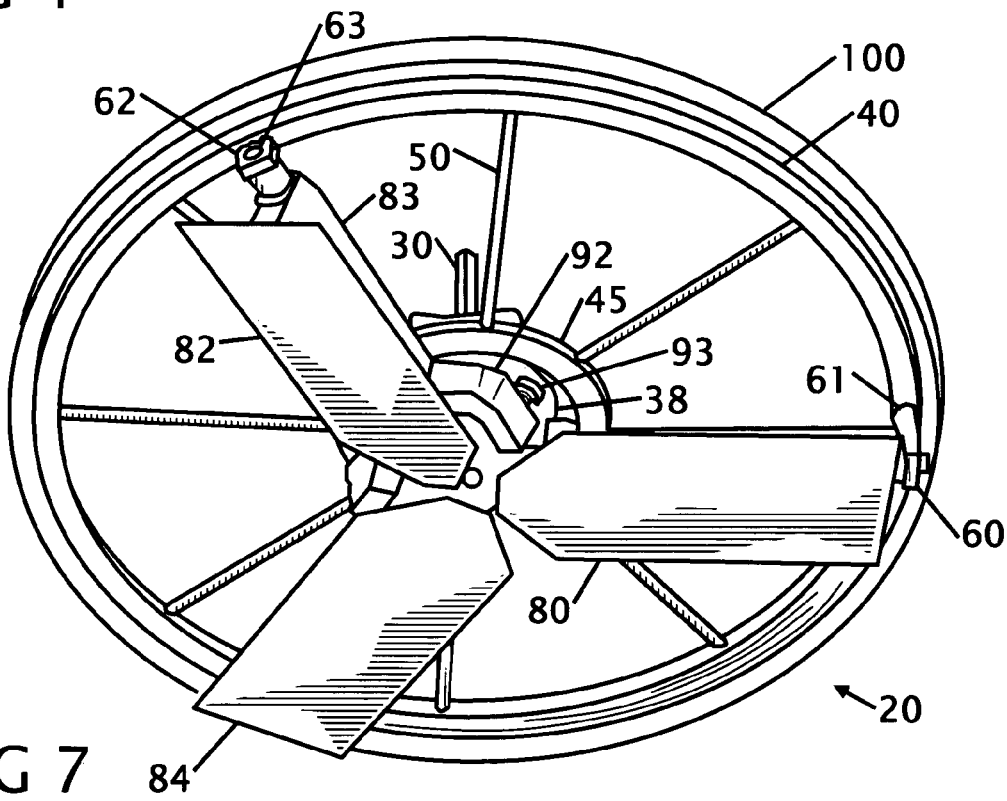
FIG. 7 shows a lower isometric view of the trowel showing the pivoting components on one trowel.

FIG. 7 shows a lower isometric view of the trowel 20 showing the pivoting components on one trowel blade 82. The input shaft is visible in this view. The outer ring 40 and the inner ring in shown with ribs 50 connecting between these two rings. The troweling blades 80, 82 and 84 are shown where blade 82 is attached to blade support 83. This same blade is shown attached with outer bearing 62 in outer bearing riser 63. Another outer bearing riser 61 and bearing 60 is visible on blade 80. A portion of the stop plate 38 is shown through the inner ring 45. Arm 92 is shown with bolt 93 in a rotated position where the head of the bolt is off the stop plate 38. The bolt 93 is adjustable to limit or stop free rotation of the trowel blade 82. The top cover 100 is shown extending over the ends of the troweling blade. The top cover is shown and described in more detail in FIG. 8.

Figure 8:
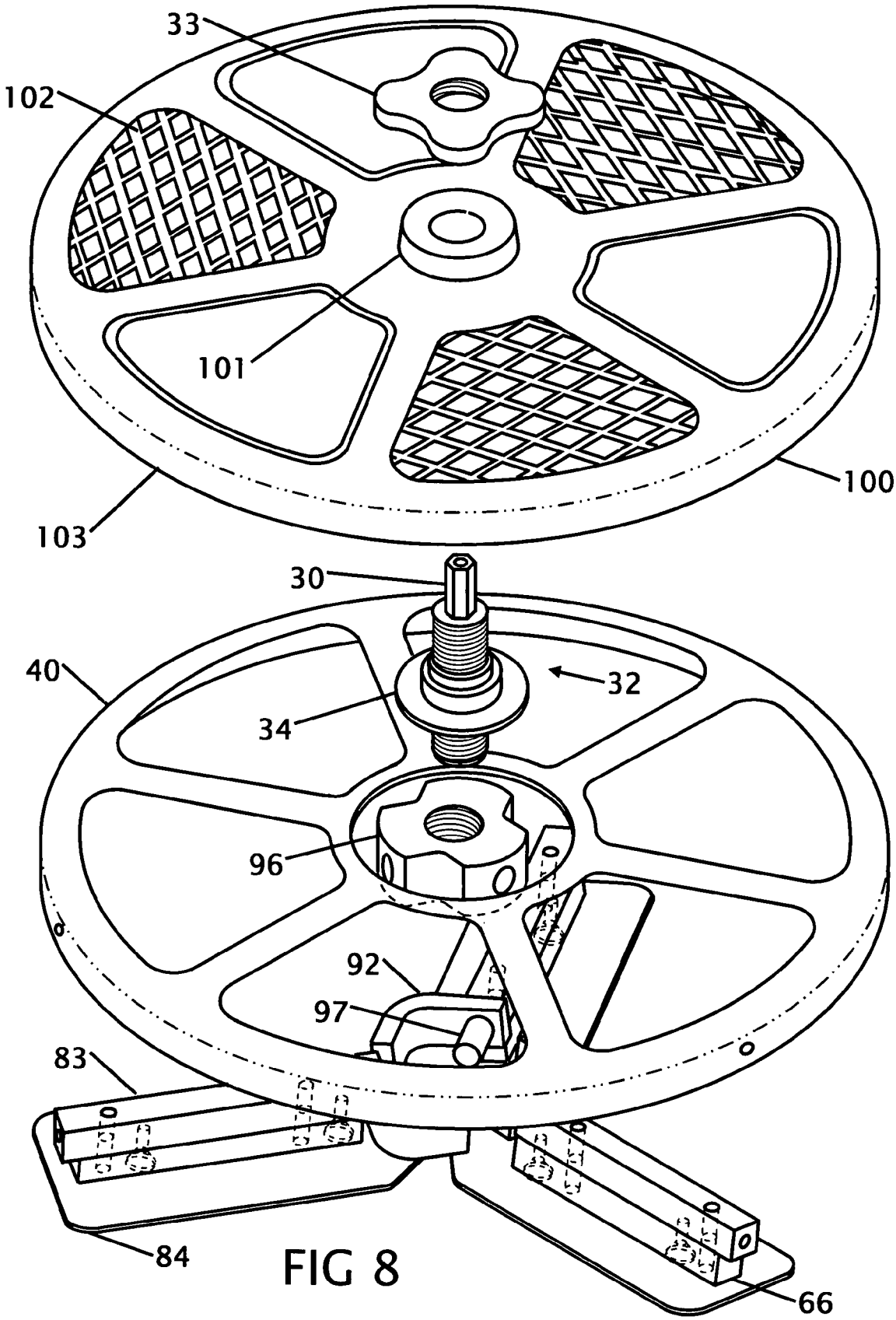
FIG. 8 is an isometric exploded view of the trowel with fixed blades and a protective cover.

FIG. 8 is an isometric exploded view of the trowel with fixed blades and a protective cover 100. The troweling blades 84 are secured to an angle block 66. The angle block 66 maintains the angle of the blade(s) at a fixed relationship with the surface being smoothed. It is contemplated that the angle blocks are manufacturable at different angles based upon the smoothing needs. Each angle block 66 is secured to a trowel support 83. The trowel support is pivotably connected on one end to the safety ring 40, and at the other end to hub 96. The trowel support has an arm 92 that is bent at an angle to allow for the pivotal movement and has a bearing pin 97 that fits into the complimentary hole in the hub 96. The hub 96 threads into the central hub 32.

The cover 100 fits over the hub 32 where it can freely spin on the hub. The top cover drapes over the safety ring 40 and the troweling blades 84. The cover ends 103 slightly above the bottom of the blades 80 to prevent to cover from marking the toweled surface. In operation when the cover makes contact with a surface outside of the troweling blades the cover stops moving while the blades continue to spin under the cover. Damage to the surface is prevented. The cover protects walls, and the user from accidentally coming in contact with the blades. The top cover has vents 102 that allow excess material to be pushed through the vents to prevent a build-up of material between the blades, 84, safety ring 40 and the top cover 100. The connection of the top cover to the central shaft is with a raised dome 101 that rests on a ring 34 extending from the hub. The ring provides a bearing surface and keeps the cover centered on the hub 32. It is also contemplated that a bearing is usable on the top cover to make the top cover turn more easily, but prototypes have been made where the top cover turns on the hub without a separate bearing. The hub 96 and the nut 33 are configured with extended lobes to allow an operator to grasp assemble and disassemble the trowel without tools. The top of the hub 32 has an extended shaft 30 that allows the power trowel to be chucked in a portable drill.

Thus, specific embodiments of a power trowel attachment for a drill have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A drill attachment comprising:

a plurality of elongated troweling blades extending from a central shaft;

each blade is secured to said central shaft with an elongated support having an outer pivotable connection at a first elongated end and an inner pivotable connection at the opposing elongated end;

a changeable angle block secured to said elongated support on one side and to each of said plurality of elongated troweling blades on the other side of the angle block;

said changeable angle blocks being constructed at fixed angles and are changeable based upon the use of said drill attachment.

2. The drill attachment as defined in claim 1 that further includes a cover that extends over the plurality of elongated troweling blades in a rotational engagement with said central shaft such that the cover can rotate in unison and independently from the central shaft.

3. The drill attachment as defined in claim 1 wherein said changeable angle blocks cerate and angle between the blade and the elongated support of between 0 and 25 degrees.

4. The drill attachment as defined in claim 1 wherein the inner pivotable connection has an offset arm that allows a leading edge of the troweling blade to rotate above a surface being troweled.

5. The drill attachment as defined in claim 1 wherein the central shaft is threaded to allow disassembly of the drill attachment.

6. The drill attachment as defined in claim 5 wherein the central shaft utilizes threaded nuts having a plurality of lobes that allow the nut to be tightened and removed with hands.

7. The drill attachment as defined in claim 2 wherein the cover is configured with at least one vent that allows material between the troweling blades and the top cover to be expelled.

8. The drill attachment as defined in claim 1 that allows the drill attachment to be completely removable from a drill.

9. The drill attachment as defined in claim 6 wherein the lobes allows the user to prevent rotation of the central shaft and a drill.

10. The drill attachment as defined in claim 1 that further includes a support ring secured between the outer pivotable connection and the central shaft.

11. A drill attachment comprising:

a plurality of elongated troweling blades extending from a central shaft that allows temporal securing of the drill attachment to a separate motor;

each of said plurality of troweling blades is secured to said central shaft with an elongated support having an outer pivotable connection at a first elongated end and an inner pivotable connection at the opposing elongated and each troweling blade is secured to the elongated support with a changeable angle block, a cover that extends from said central shaft over the plurality of elongated troweling blades in a rotational engagement with a bearing connecting said cover with said central shaft such that the cover can rotate in unison with said central shaft and independently from the central shaft when the cover makes contact with a surface.

12. The drill attachment as defined in claim 11 wherein the cover is configured with at least one vent that allows material between the troweling.

13. The drill attachment as defined in claim 11 wherein the central shaft is threaded to allow disassembly of the drill attachment.

14. The drill attachment as defined in claim 13 wherein the central shaft utilizes threaded nut having a plurality of lobes that allow the nut to be tightened and removed with hands without the use of a wrench, key or other tool.

15. The drill attachment as defined in claim 14 wherein the lobes allows the user to prevent rotation of the central shaft and a drill.

16. The drill attachment as defined in claim 11 wherein the cover extends from the central shaft across the top of the plurality of elongated troweling blades and essentially vertically down the sides of the elongated troweling blades where it terminates in a location above the bottom surface of the elongated troweling blades.

17. The drill attachment as defined in claim 11 wherein the cover, has a raised central portion that allows the cover to center itself on the central shaft.

18. The drill attachment as defined in claim 11 wherein the said changeable angle blocks cerate and angle between the blade and the elongated support of between 0 and 25 degrees.

19. A drill attachment comprising:

a plurality of elongated troweling blades extending from a central shaft that allows temporal securing of the drill attachment to a separate motor;

the central shaft has a threaded nut with a plurality of lobes that allow the nut to be tightened and removed with hands without the use of a wrench, key or other tool and the lobes allows a user and to prevent rotation of the central shaft and a drill;

a cover that extends from said central shaft over the plurality of elongated troweling blades in a rotational engagement with a bearing connecting said cover with said central shaft such that the cover can rotate in unison with said central shaft and independently from the central shaft when the cover makes contact with a surface.

20. The drill attachment as defined in claim 19 wherein each of said plurality of troweling blades is secured to said central shaft with an elongated support having an outer pivotable connection at a first elongated end and an inner pivotable connection at the opposing elongated and each troweling blade is secured to the elongated support with a changeable angle block.

* * * * *